US008905788B2

(12) United States Patent
Oniyama et al.

(10) Patent No.: US 8,905,788 B2
(45) Date of Patent: Dec. 9, 2014

(54) CONNECTOR AND SEMICONDUCTOR TESTING DEVICE INCLUDING THE CONNECTOR

(75) Inventors: Kyoko Oniyama, Yamato (JP); Akinori Mizumura, Yokohama (JP); Shin Sakiyama, Tokyo (JP); Hiroyuki Hama, Tokyo (JP); Hiromitsu Takasu, Tokyo (JP)

(73) Assignees: Molex Japan Co. Ltd., Yamato (JP); Advantest Corporation, Tokyo (JP)

( * ) Notice: Subject to any disclaimer, the term of this patent is extended or adjusted under 35 U.S.C. 154(b) by 367 days.

(21) Appl. No.: 13/378,007

(22) PCT Filed: Jun. 30, 2010

(86) PCT No.: PCT/US2010/040526
§ 371 (c)(1),
(2), (4) Date: Dec. 13, 2011

(87) PCT Pub. No.: WO2011/002840
PCT Pub. Date: Jan. 6, 2011

(65) Prior Publication Data

US 2012/0088410 A1 Apr. 12, 2012

(30) Foreign Application Priority Data

Jun. 30, 2009 (JP) ..... 2009-156360

(51) Int. Cl.
*H01R 24/00* (2011.01)
*H01R 13/6473* (2011.01)
*H01R 12/71* (2011.01)
*H01R 13/6471* (2011.01)

(52) U.S. Cl.
CPC ..... *H01R 12/716* (2013.01); *H01R 13/6473* (2013.01); *H01R 13/6471* (2013.01)
USPC ..... 439/626

(58) Field of Classification Search
CPC ..... H01R 12/716; H01R 13/6471; H01R 13/6473; H01R 4/34
USPC ..... 439/625–626, 260, 108, 657, 66
See application file for complete search history.

(56) References Cited

U.S. PATENT DOCUMENTS 5,026,292 A * 6/1991 Pickles et al. ..... 439/108
5,919,064 A * 7/1999 Petersen et al. ..... 439/637

(Continued)

FOREIGN PATENT DOCUMENTS

EP 2 015 401 A2 1/2009
JP H02-175394 3/1992

(Continued)

OTHER PUBLICATIONS

International Search Report for PCT/US2010/040526.

*Primary Examiner* — Edwin A. Leon
(74) *Attorney, Agent, or Firm* — Timothy M. Morella

(57) ABSTRACT

Each of the signal terminal and the ground terminal includes a first extending portion extending toward its tip end, and a second extending portion extending in a direction opposite to the first extending portion. The first extending portion is formed such that a width thereof is smaller than a width of the second extending portion. The housing includes a first housing into which the first extending portions are inserted, and a second housing into which the second extending portions are inserted. The second housing is formed separately from the first housing, and the first housing includes a wall portion located between the first extending portion of the signal terminal and the first extending portion of the ground terminal.

7 Claims, 10 Drawing Sheets

(56) References Cited

U.S. PATENT DOCUMENTS

| | | | | |
|---|---|---|---|---|
| 6,019,639 | A * | 2/2000 | Brunker et al. | 439/637 |
| 6,454,605 | B1 | 9/2002 | Bassler et al. | |
| 6,652,296 | B2 | 11/2003 | Kuroda et al. | |
| RE38,736 | E * | 5/2005 | Walse et al. | 439/60 |
| 2004/0053532 | A1 | 3/2004 | Jones | |

FOREIGN PATENT DOCUMENTS

| | | |
|---|---|---|
| JP | 3677594 | 10/2001 |
| WO | PCT/JP07/67672 | 3/2009 |

* cited by examiner

CONNECTOR AND SEMICONDUCTOR TESTING DEVICE INCLUDING THE CONNECTOR

FIELD OF THE INVENTION

The present invention relates to a connector including a signal terminal and a ground terminal, and a semiconductor testing device including the connector, and more particularly, to technology for improving impedance matching.

BACKGROUND OF THE INVENTION

Heretofore, there has been used a connector to which electronic components (for example, coaxial cables and a circuit board) including conductors for signal transmitting and conductors for grounding are connected. Such a connector includes terminals for signal transmission (hereinafter, referred to as signal terminals) and terminals for grounding (hereinafter, referred to as ground terminals). For example, Patent Document 1 described below discloses a connector to which coaxial cables are connected.

In the connector disclosed in Patent Document 1, a signal terminal and a ground terminal are arranged side by side in a right-and-left direction. The signal terminal is formed like a plate spring elongated in a direction in which the terminal is inserted into a housing, and elastic force of the signal terminal presses the tip end of the signal terminal against a signal terminal provided at end of the coaxial cable. In a similar manner, the ground terminal is formed like a plate spring elongated in a direction in which the terminal is inserted into a housing, and elastic force of the ground terminal presses the tip end of the ground terminal against a ground terminal provided at the end of the coaxial cable.

SUMMARY OF THE INVENTION

A terminal whose tip side is formed thinner than its base side is used as a signal terminal and a ground terminal in some cases. For example, in order to lower the elastic force of the terminal and maintain a contact pressure between the conductor of an electronic component to be connected with the connector and the tip end of the terminal in the connector, the tip side of the terminal is formed thinner than its base side in some cases.

However, when the terminal as described above is used as a signal terminal and a ground terminal arranged side by side in the right-and-left direction, impedance matching in a signal transmission line is deteriorated. In detail, the distance between the tip side of the signal terminal and the tip side of the ground terminal is larger than the interval between the base side of the signal terminal and the base side of the ground terminal, because the tip sides of the terminals are formed thinner than their base sides. Therefore, impedance on the tip sides of the terminals is larger than impedance on their base sides.

The present invention has been made in view of the above-mentioned problem. It is an object of the present invention to provide a connector including a signal terminal and a ground terminal which are arranged next to each other, the connector being capable of preventing the deterioration in impedance matching due to thinning of the tip sides of the terminals.

In order to solve the above-mentioned problem, according to the present invention, there is provided a connector including: a signal terminal and a ground terminal, which are arranged next to each other; and a housing into which the signal terminal and the ground terminal are inserted. Each of the signal terminal and the ground terminal includes a first extending portion extending toward a tip end thereof, and a second extending portion extending in a direction opposite to the first extending portion. The first extending portion of at least one of the signal terminal and the ground terminal is formed to have a width smaller than a width of the second extending portion of the at least one of the signal terminal and the ground terminal. The housing includes a first housing into which the first extending portion of the signal terminal and the first extending portion of the ground terminal are inserted, and a second housing into which the second extending portion of the signal terminal and the second extending portion of the ground terminal are inserted. The second housing is formed separately from the first housing, and the first housing includes a wall portion located between the first extending portion of the signal terminal and the first extending portion of the ground terminal.

Further, according to the present invention, there is provided a semiconductor testing device including a circuit board on which the above-mentioned connector is mounted.

According to the present invention, it becomes easy to suppress the deterioration in impedance matching which results from the fact that the width of the first extending portion of one of the terminals is smaller than the width of the second extending portion thereof. Specifically, because the second housing and the first housing are formed separately from each other, designing the wall portion located between the first extending portion of the signal terminal and the first extending portion of the ground terminal can be flexible as compared to a structure where the second housing and the first housing are integrally molded. That is, the wall portion formed in the first housing can be formed to have a shape capable of suppressing the deterioration in impedance matching. Further, a material of the first housing and a material of the second housing can be different from each other, whereby the deterioration in impedance matching can be suppressed.

Further, according to one aspect of the present invention, the first extending portion of the at least one of the signal terminal and the ground terminal may be formed such that the width thereof becomes smaller toward its tip end. According to this aspect, an elastic force of each of the terminals can be reduced and the contact pressure between the conductors of the electronic component connected to the connector and the tip end of the terminal can be maintained.

In this aspect, the first extending portion of the signal terminal and the first extending portion of the ground terminal may include, on their tip sides, contact portions for contacting a surface of an electronic component on which the connector is mounted, and the first extending portions may be curved so that positions of the contact portions are elastically movable up and down. With this structure, in a connector that is electrically connected to the electronic component by being pressed on the surface of the electronic component, the elastic forces of the terminals can be lowered while maintaining the contact pressures between the conductors of the electronic component and the tip ends of the terminals.

Further, in this aspect, the wall portion formed in the first housing may be formed to become thicker toward its portion between the tip end of the first extending portion of the signal terminal and the tip end of the first extending portion of the ground terminal. With this structure, the deterioration in impedance matching can be appropriately suppressed.

Further, according to one aspect of the present invention, the first housing and the second housing may be formed of materials different in dielectric constant from each other. According to this aspect, it becomes easy to suppress the deterioration in impedance matching.

Further, according to one aspect of the present invention, the second extending portions are press-fitted into the second housing, and hence the signal terminal and the ground terminal may be held by the second housing. According to this aspect, the second extending portions having larger rigidity than the first extending portions are held. As a result, compared to the case where the first extending portions are held, strength in holding the signal terminal and the ground terminal can be increased.

DESCRIPTION OF THE PREFERRED EMBODIMENTS

Figure 1:
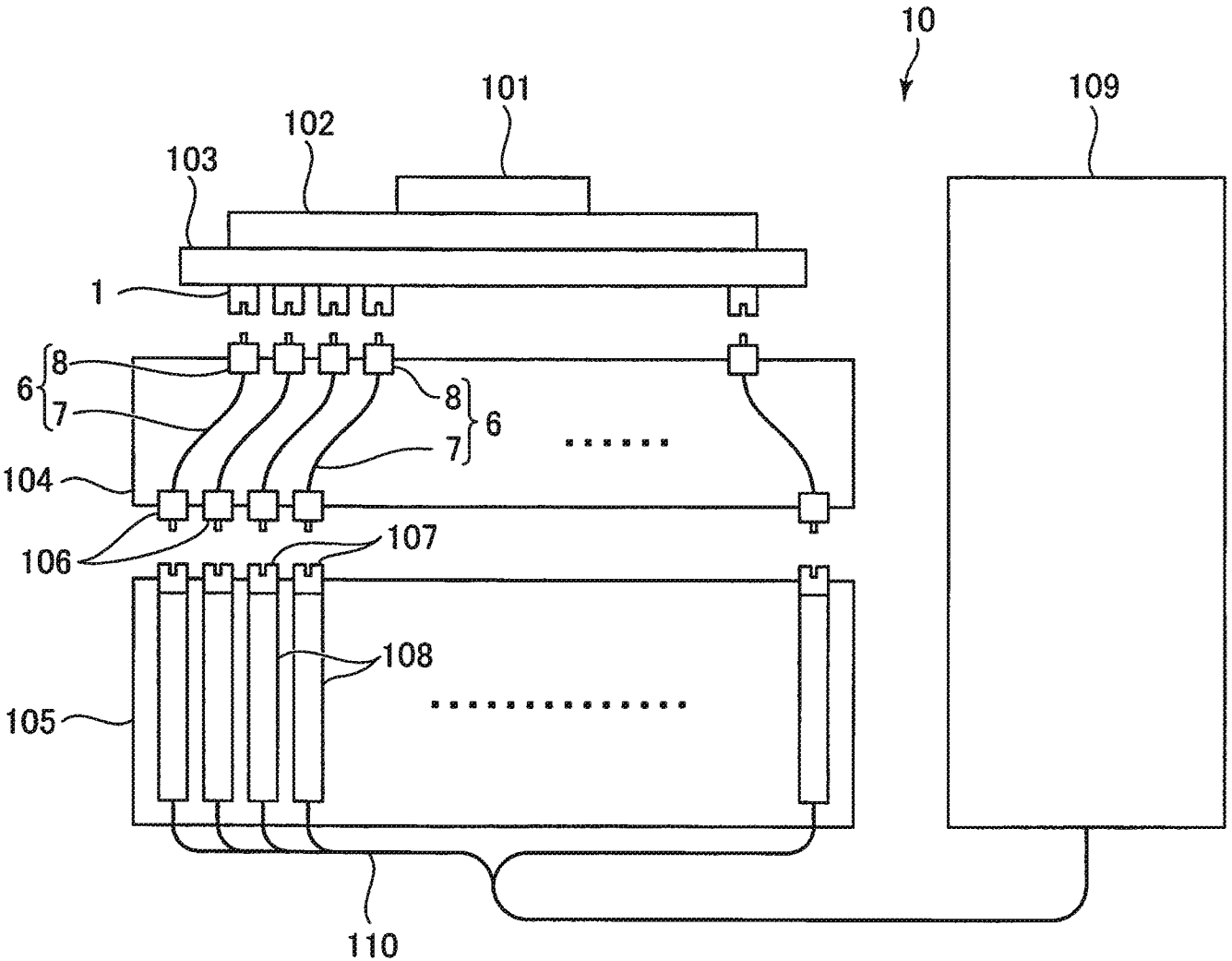
FIG. 1 is a schematic view of a semiconductor testing device including a connector according to an embodiment of the present invention.
Figure 2:
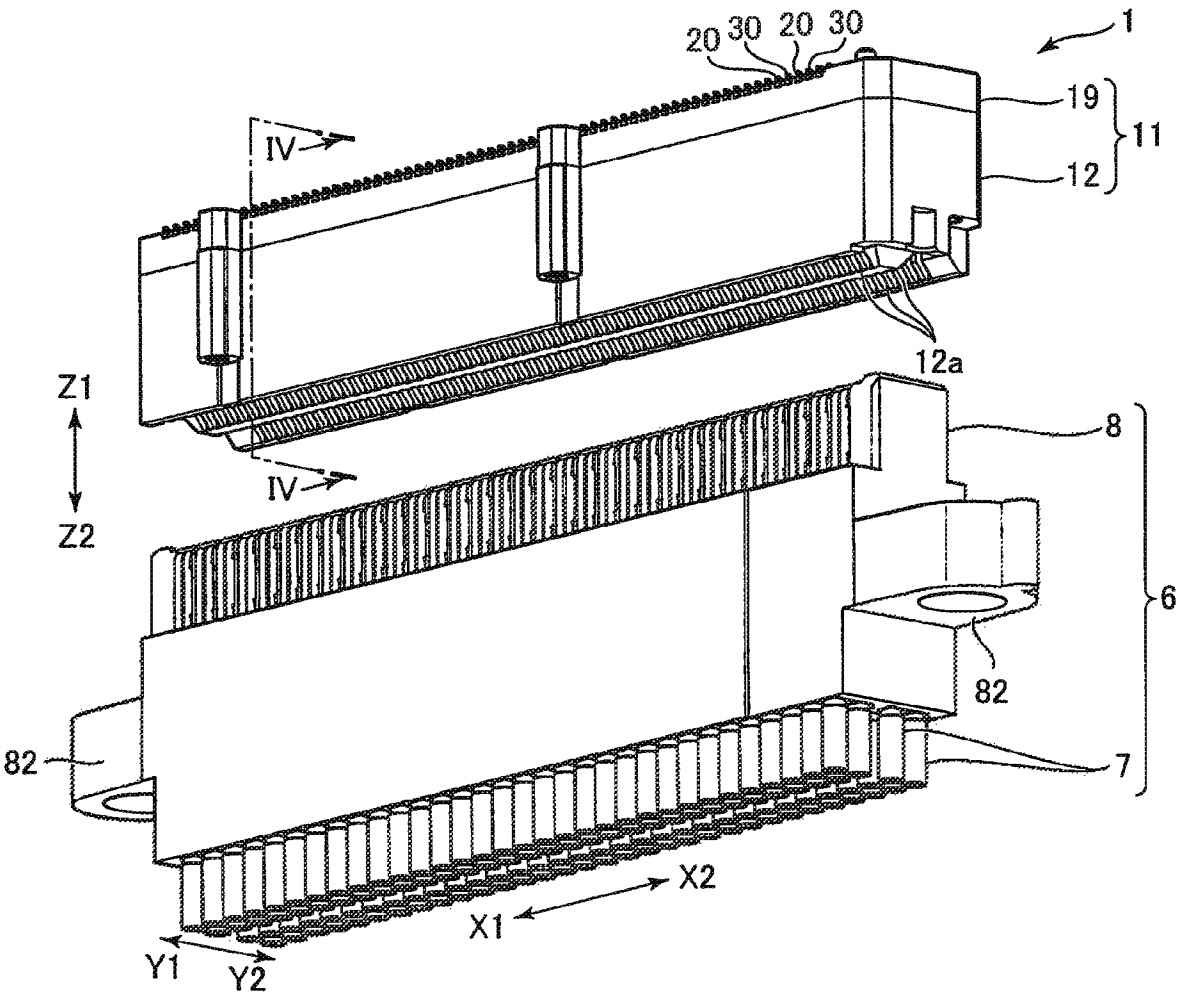
FIG. 2 is an exploded perspective view of the connector and a cable assembly to be connected with the connector.
Figure 3:
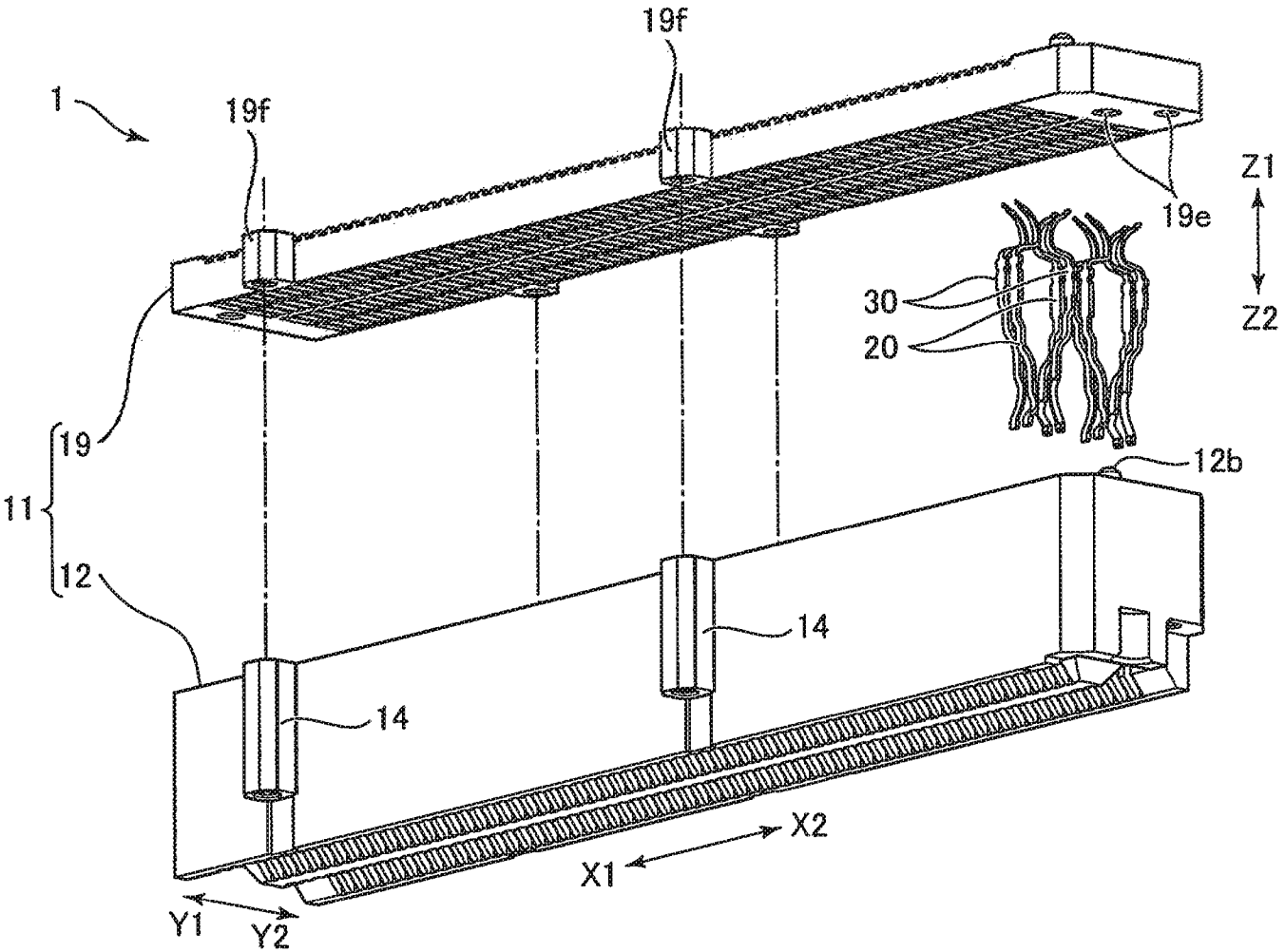
FIG. 3 is an exploded perspective view of the connector.
Figure 4:
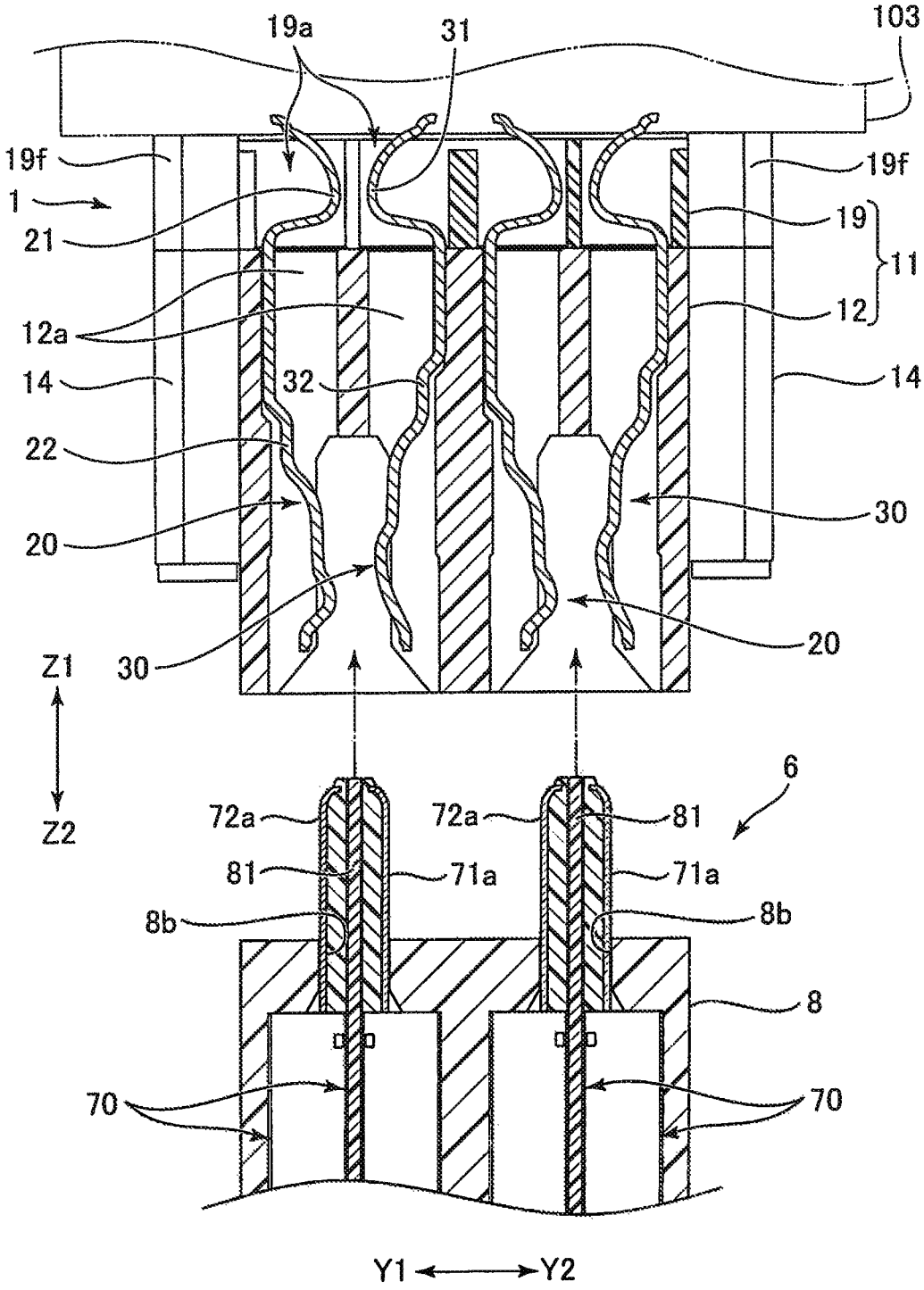
FIG. 4 is a cross-sectional view taken along the line IV-IV of FIG. 2, in which the cable assembly is illustrated in addition to the connector.
Figure 5:
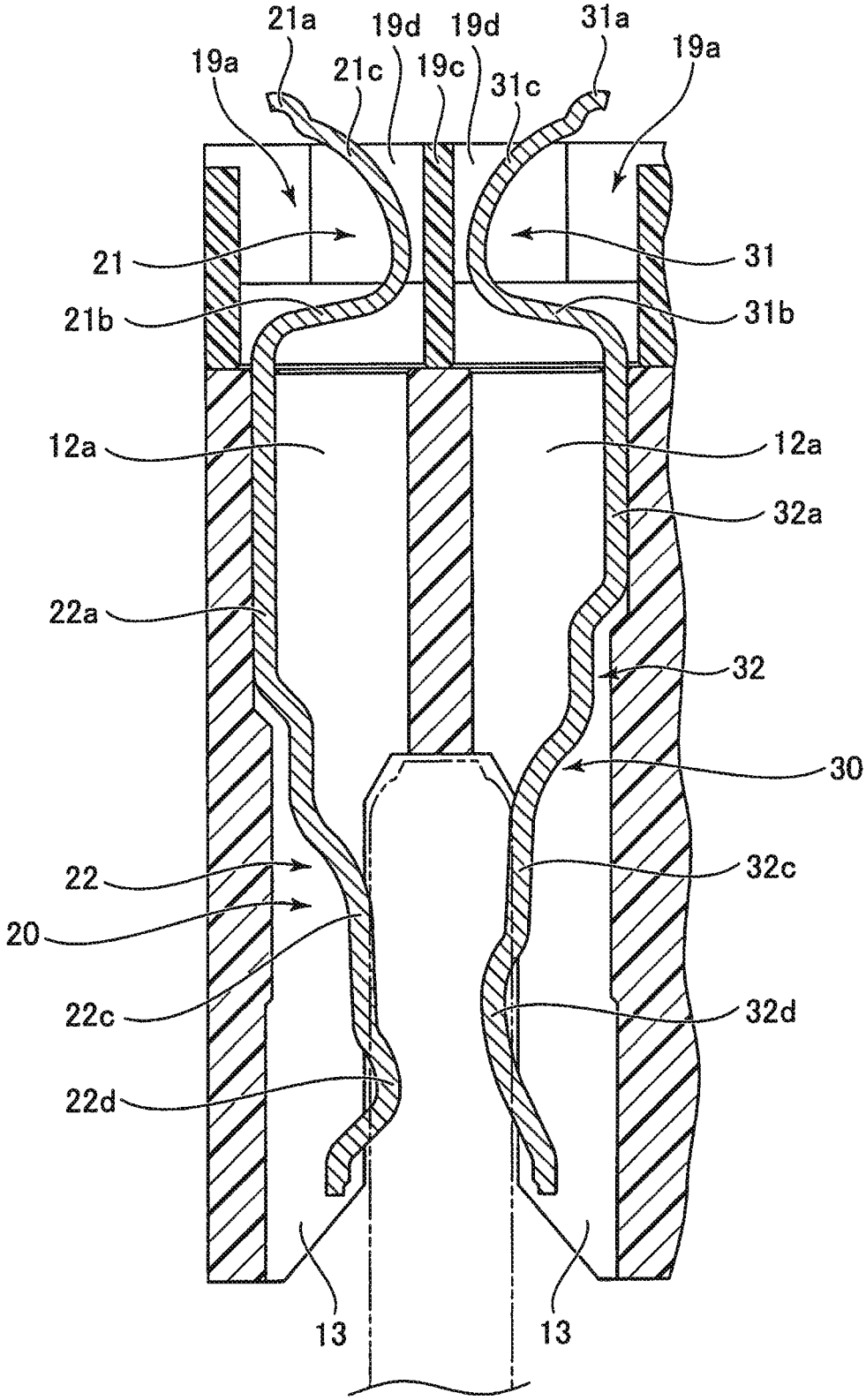
FIG. 5 is an enlarged view of the connector.
Figure 6:
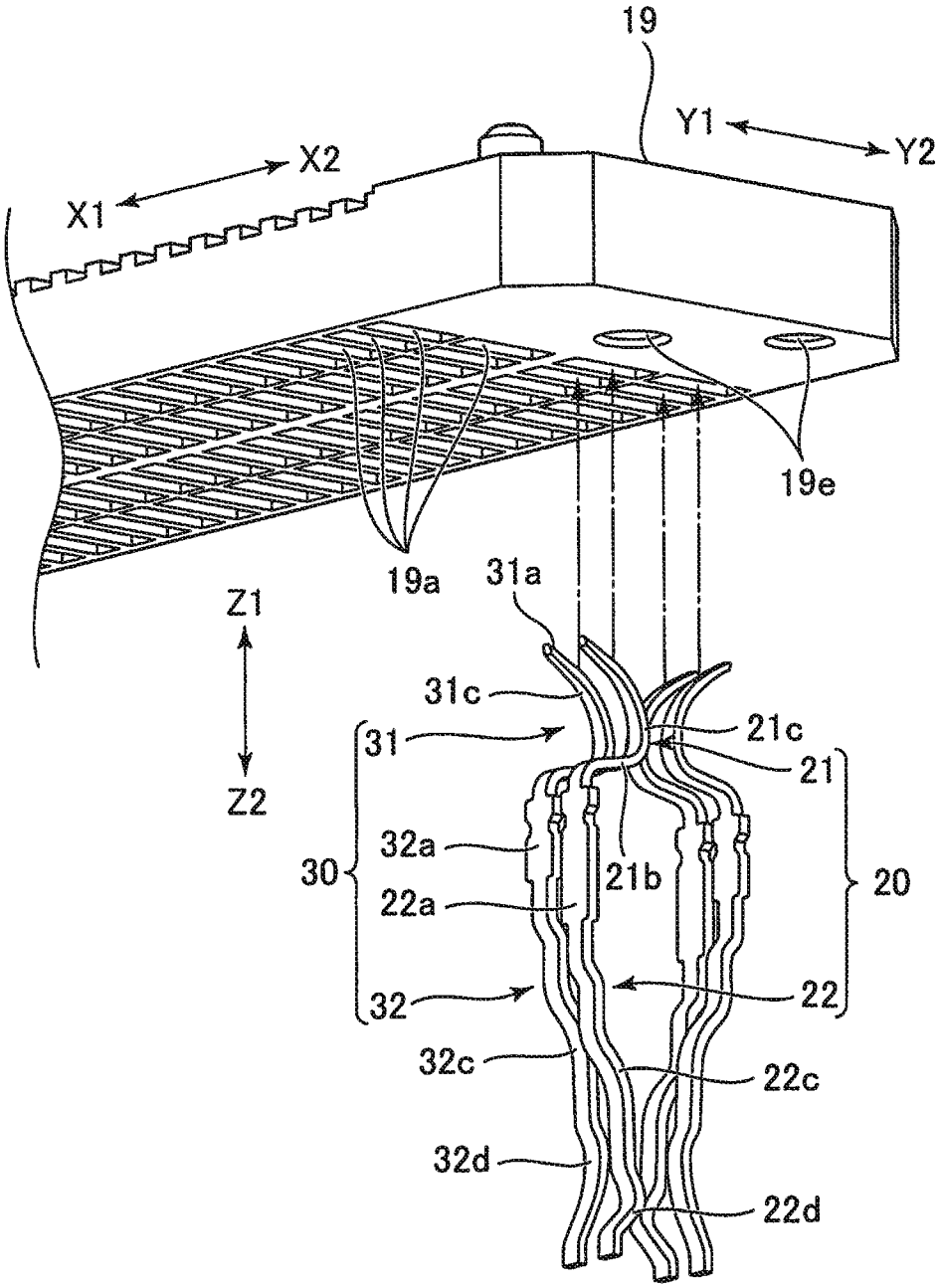
FIG. 6 is an enlarged view of FIG. 3.
Figure 7:
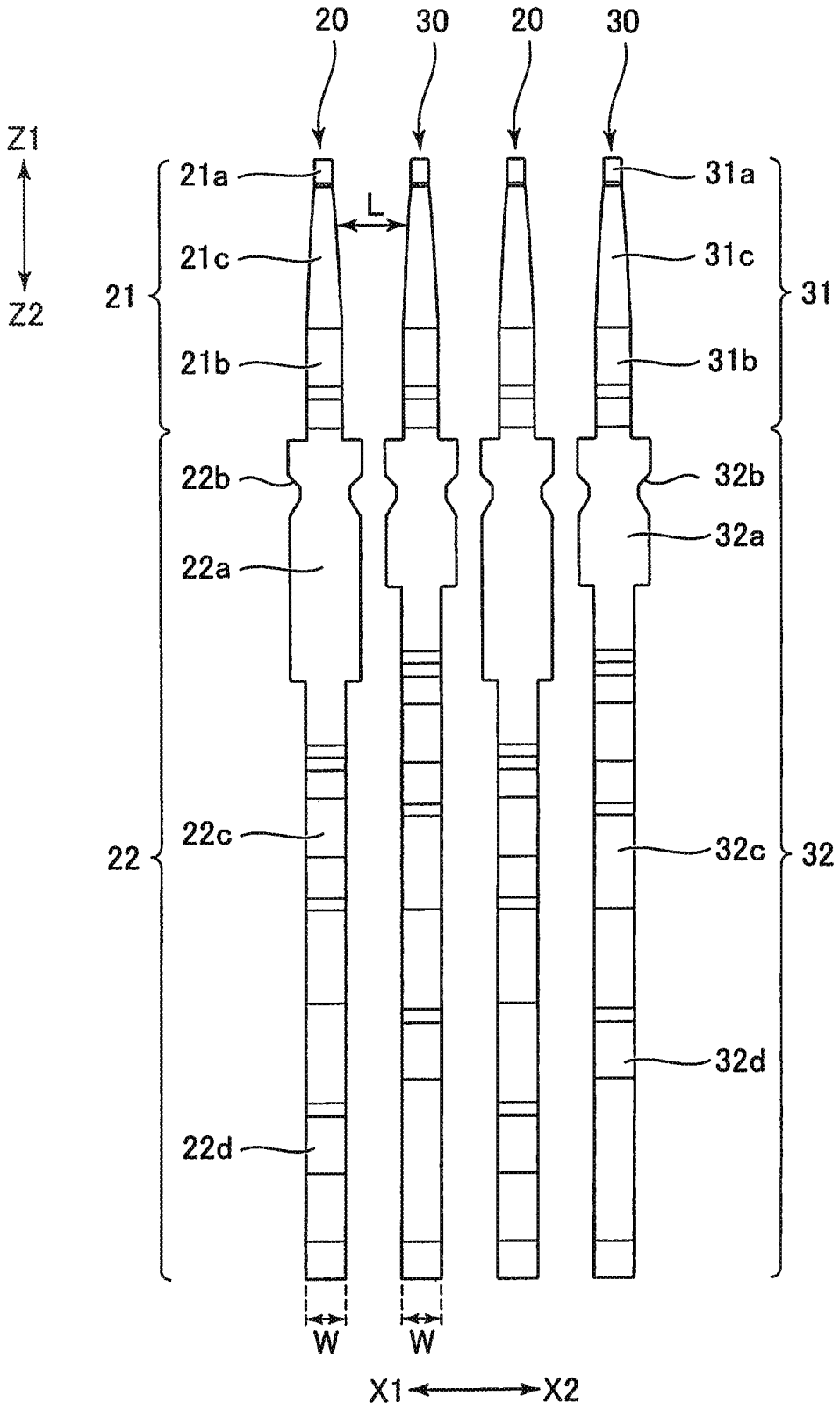
FIG. 7 is a plan view of ground terminals and signal terminals, which constitute the connector.
Figure 8:
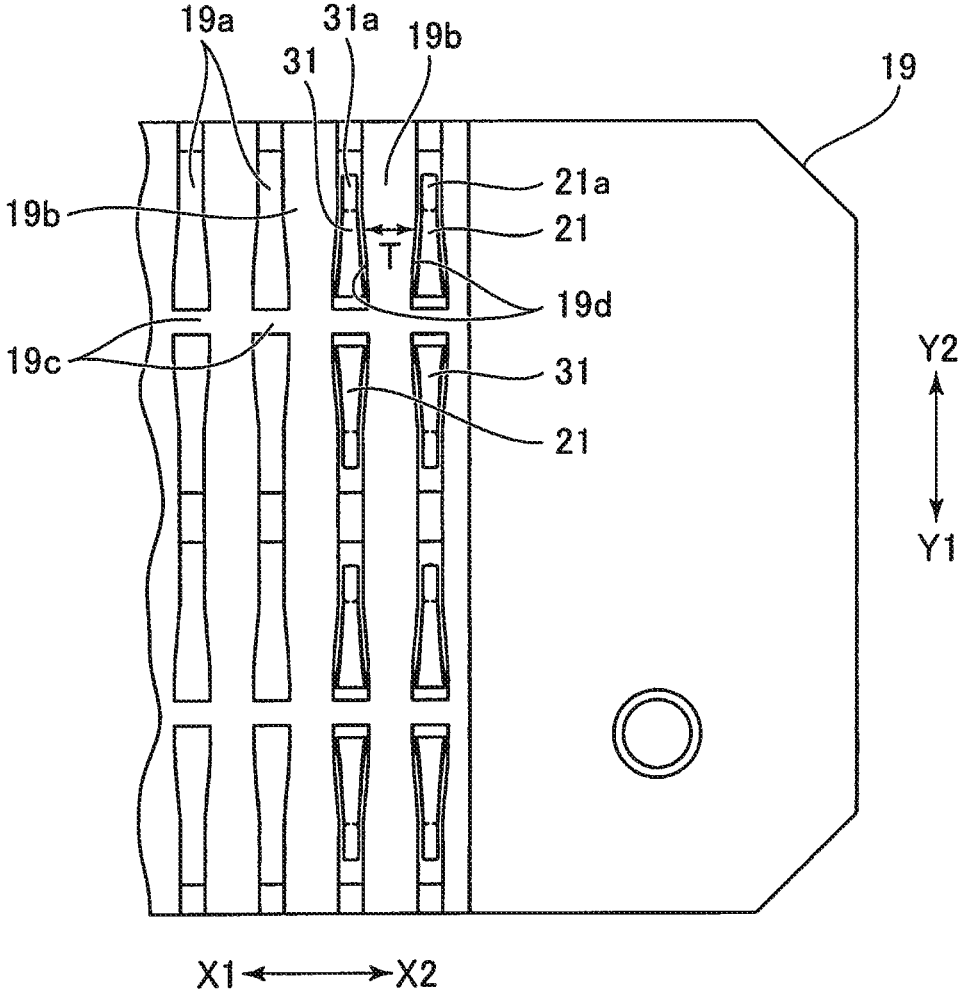
FIG. 8 is a view of the connector viewed from the above.
Figure 9:
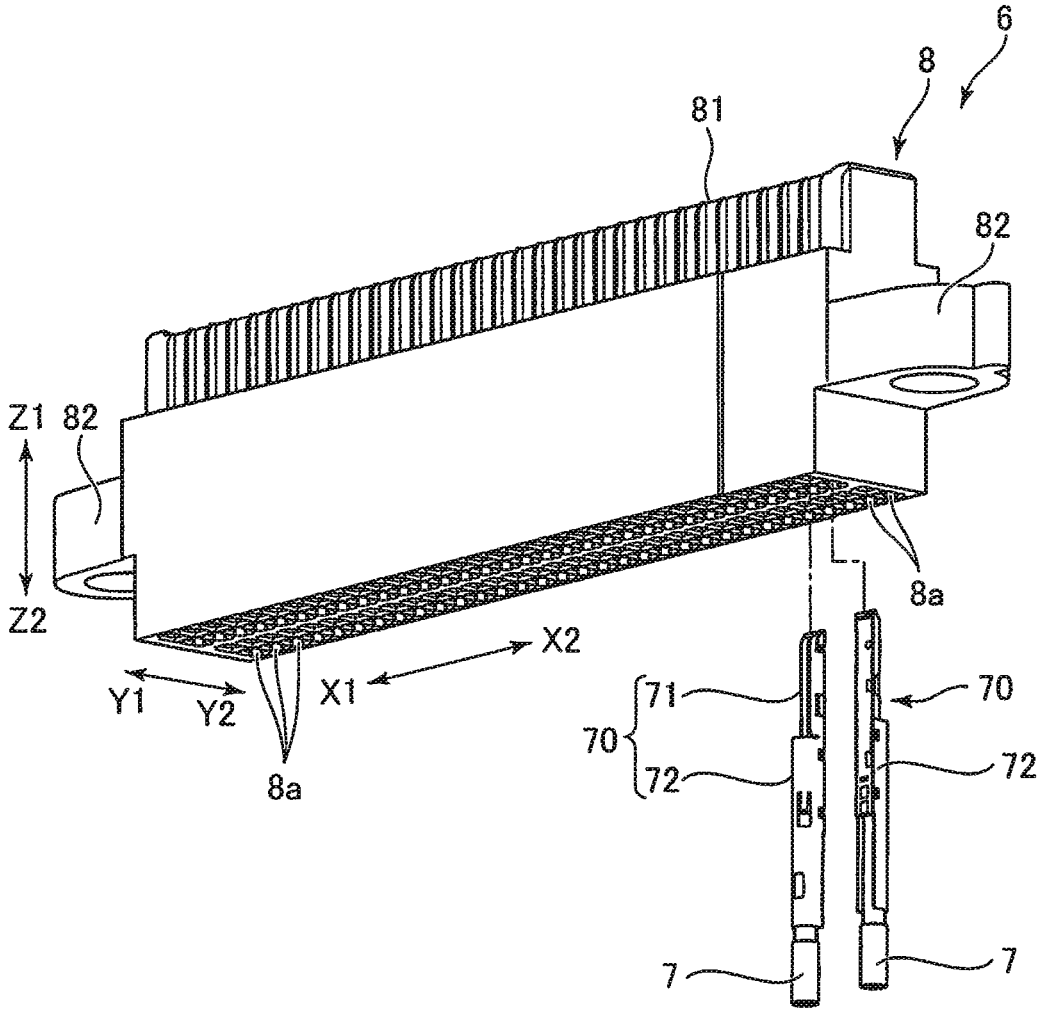
FIG. 9 is an exploded perspective view of the cable assembly.
Figure 10:
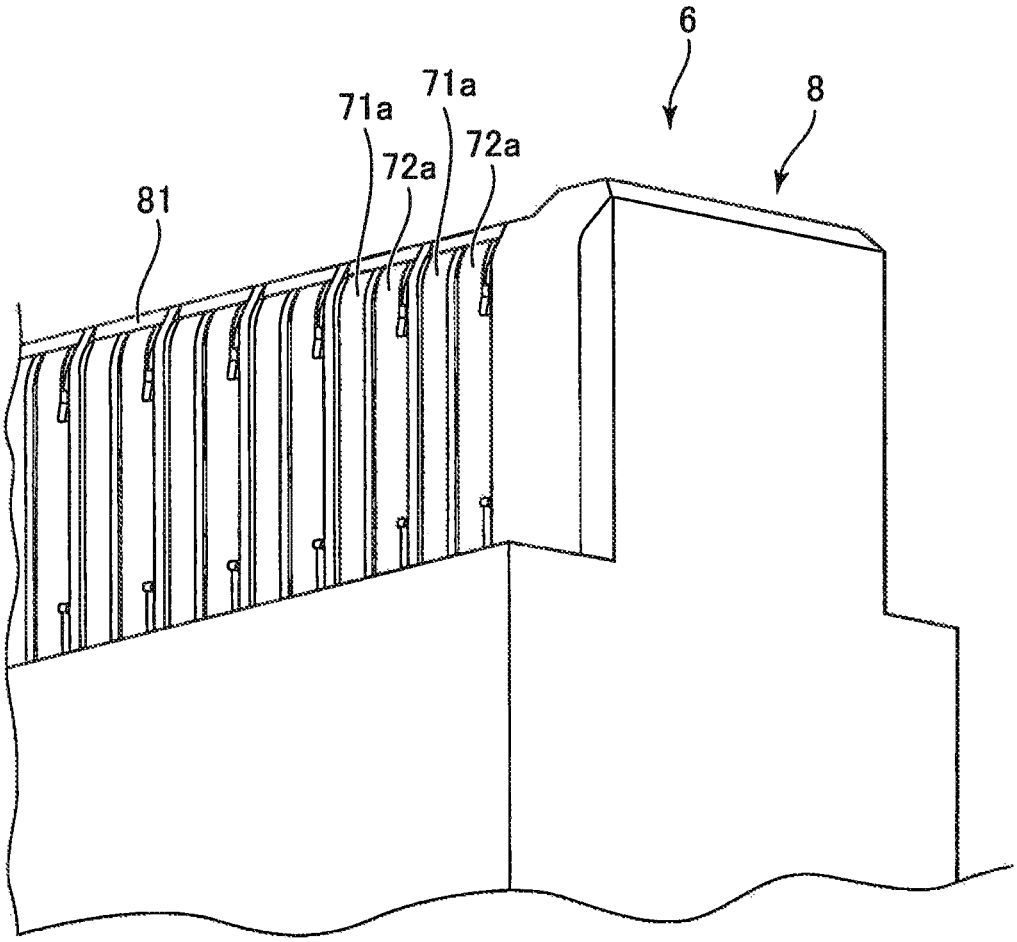
FIG. 10 is an enlarged view of the cable assembly.

Description will be given of an embodiment of the present invention while referring to the drawings. FIG. 1 is a schematic view of a semiconductor testing device 10 provided with a connector 1 as an example of the embodiment according to the present invention. FIG. 2 is an exploded perspective view of the connector 1 and a cable assembly 6 connected to the connector 1, and FIG. 3 is an exploded perspective view of the connector 1. FIG. 4 is a cross-sectional view taken along the line IV-IV indicated in FIG. 2, in which the cable assembly 6 is illustrated in addition to the connector 1. FIG. 5 is an enlarged view of the connector 1, and FIG. 6 is an enlarged view of FIG. 3. FIG. 7 is a plan view of ground terminals 20 and signal terminals 30, which constitute the connector 1. FIG. 8 is a view of the connector 1 viewed from the above. FIG. 9 is an exploded perspective view of the cable assembly 6, and FIG. 10 is an enlarged view of the cable assembly 6.

As illustrated in FIG. 1, the semiconductor testing device 10 includes: a test head 105; a motherboard 104 arranged on the test head 105; a performance board (circuit board) 103 arranged on the motherboard 104; and a device socket 102 arranged on the performance board 103. A semiconductor 101 as a test target is mounted on the device socket 102, and connected to the performance board 103 through the device socket 102. A plurality of the connectors 1 are attached on a back surface of the performance board 103. The connector 1 includes a plurality of terminals 20 and 30 to be described later, and the respective terminals 20 and 30 are electrically connected to terminals of the semiconductor 101 through transmission lines formed in the performance board 103 and through terminals provided in the device socket 102. A plurality of connectors 8 are mounted on an upper surface of the motherboard 104, and a plurality of coaxial cables 7 accommodated in the motherboard 104 are connected to each of the connectors 8 (refer to FIG. 2 and FIG. 9). The plurality of connectors 8 are individually held at positions corresponding to the connectors 1 provided on the performance board 103, and the performance board 103 or the motherboard 104 is moved in an vertical direction, whereby the plurality of connectors 8 may be fitted at one time to the connectors 1 corresponding thereto. In this context, as illustrated in FIG. 9, the cable assembly 6 is constituted by the plurality of coaxial cables 7 and the connectors 8 to which the coaxial cables 7 are connected. In this example, the plurality of coaxial cables 7 are arranged in a right-and-left direction (X1-X2 direction) and a front-and-back direction (Y1-Y2 direction). Moreover, the connector 8 includes attachment portions 82 for fixing the connector 8 to the upper surface of the motherboard 104. The attachment portions 82 are fixed to the motherboard 104, for example, by bolts or rivets.

A plurality of connectors 106 are held on a lower surface of the motherboard 104. Lower ends of the coaxial cables 7 are connected to each of the connectors 106. On an upper surface of the test head 105, a plurality of connectors 107 connected to the connectors 106 are provided. Testing modules 108 accommodated in the test head 105 are respectively fixed to the respective connectors 107. The testing modules 108 are connected to a testing-device main-body 109 through a transmission line 110. The testing modules 108 generate test signals under control of the testing-device main-body 109, and the test signals are inputted to the semiconductor 101 through the coaxial cables 7, the connectors 1, the performance board 103, and the like.

As illustrated in FIG. 3, the connector 1 includes a ground terminal 20 and a signal terminal 30, which are arranged next to each other. In this example, the connector 1 includes a plurality of the ground terminals 20 and a plurality of the signal terminals 30, and the ground terminals 20 and the signal terminals 30 are arrayed at equal intervals and alternately arranged in the right-and-left direction (X1-X2 direction) (refer to FIG. 7). As illustrated in FIG. 9 or FIG. 10, a cable terminal 70, which is fixed at the end of each coaxial cable 7 and is to be brought into contact with the ground terminal 20 and the signal terminal 30, includes a ground terminal 72 connected to ground line constituting the coaxial cable 7, and a signal terminal 71 connected to signal line constituting the coaxial cable 7. The ground terminal 72 includes a slim plate-shaped contact plate 72*a* on its tip side. The signal terminal 71 also includes a slim plate-shaped contact plate 71*a*. The contact plates 72*a* and 71*a* are arranged next to each other and extend upward (in a Z1 direction) respectively. The plurality of coaxial cables 7 are arrayed in the right-and-left direction, so that in a similar way to the ground terminals 20 and the signal terminals 30, the contact plates 72*a* and 71*a* are alternately arrayed in the right-and-left direction. Then, when the cable assembly 6 is connected to the connector 1, the contact plates 72*a* and 71*a* are brought into contact with the ground terminals 20 and the signal terminals 30, respectively (refer to FIG. 4). The ground terminal 20 and the signal terminal 30 are also arrayed in the front-and-back direction (Y1-Y2 direction). As illustrated in FIG. 4, in the front-and-back direction, a ground terminal 20 and a signal terminal 30 which make a pair are arranged to face each other (refer to FIG. 4).

As illustrated in FIG. 3 or FIG. 4, the connector 1 includes a housing 11 molded of a resin. The ground terminals 20 and the signal terminals 30 are inserted into the housing 11, and are held in the housing 11. In this example, the housing 11 includes a first housing 19 and a second housing 12. The first housing 19 and the second housing 12 are formed separately. Specifically, the first housing 19 and the second housing 12 are members molded separately from each other, and are separable in the up-and-down direction (Z1-Z2 direction).

As illustrated in FIG. 6, each ground terminal 20 and each signal terminal 30 are formed into a terminal-like plate spring elongated in a direction in which they are inserted in to the housing 11 (in this example, up-and-down direction). In this example, the ground terminal 20 and the signal terminal 30 are arranged extending downward (in the Z2 direction) from the lower surface of the performance board 103 (refer to FIG. 4). The ground terminal 20 and the signal terminal 30 include first extending portions 21 and 31 extending toward tip ends (upper ends) of the terminals 20 and 30, respectively. Further, the ground terminal 20 and the signal terminal 30 include second extending portions 22 and 32 extending in a direction opposite to the first extending portions 21 and 31, that is, toward lower ends of the terminals 20 and 30.

The second extending portions 22 and 32 are inserted into the second housing 12. To be specific, as illustrated in FIG. 4 or FIG. 5, the second housing 12 has a plurality of insertion holes 12*a* formed therein, each of which passes through the second housing 12 in the up-and-down direction. The plurality of insertion holes 12*a* are arrayed in the front-and-back direction and the right-and-left direction. The second extending portions 22 and 32 are individually inserted into the insertion holes 12.

The second extending portions 22 and 32 are press-fitted into the second housing 12, whereby the ground terminals 20 and the signal terminals 30 are held by the second housing 12. To be specific, as illustrated in FIG. 6 or FIG. 7, the second extending portions 22 and 32 include fixation portions 22*a* and 32*a* in their base portions. The fixation portions 22*a* and 32*a* are formed into a flat plate shape, and include engaging portions 22*b* and 32*b* formed on right and left edges thereof. The second housing 12 includes wall portions 13 each partitioning two insertion holes 12*a* arrayed in the right-and-left direction. The second extending portions 22 and 32 are press-fitted into the insertion holes 12*a*, and the engaging portions 22*b* and 32*b* are caught on the wall portions 13 sandwiching the second extending portions 22 and 32. In such a way, the fixation portions 22*a* and 32*a* are fixed to the second housing 12, and their movement in the insertion holes 12*a* is restrained.

As illustrated in FIG. 5, the second extending portions 22 and 32 have movable portions 22*c* and 32*c* respectively, which obliquely extending from the fixation portions 22*a* and 32*a* toward lower ends of the second extending portions 22 and 32. The movable portions 22*c* and 32*c* included in a ground terminal 20 and a signal terminal 30 constituting a pair extend such that a distance between the movable portions 22*c* and 32*c* becomes smaller toward their tip ends. The movable portions 22*c* and 32*c* include contact portions 22*d* and 32*d* on their tip sides.

The contact portions 22*d* and 32*d* are brought into contact with the ground terminal 72 and the signal terminal 71 respectively, which are provided on the end of each coaxial cable 7. To be specific, as illustrated in FIG. 4, the contact plate 72*a* of the ground terminal 72 and the contact plate 71*a* of the signal terminal 71 are arranged protruding upward from a through-hole 8*b* formed in the connector 8. Further, the connector 8 includes two protruding portions 81 protruding upward. The contact plate 72*a* of the ground terminal 72, which is provided on the end of a coaxial cable 7, is located across the protruding portion 81 on an opposite side of the contact plate 71*a* of the signal terminal 71 which is provided on the end of another coaxial cable 7. Then, when the protruding portion 81 and the contact plates 72*a* and 71*a* sandwiching the protruding portion 81 between them are inserted between the movable portion 22*c* of the ground terminal 20 and the movable portion 32*c* of the signal terminal 30, the contact portions 22*d* and 32*d* are pressed on the contact plates 72*a* and 71*a* by elastic forces of the movable portions 22*c* and 32*c*. In this example, the contact portion 22*d* and the contact portion 32*d* have a positional difference in the up-and-down direction. In other words, the contact portion 32*d* is located higher than the contact portion 22*d*. Further, as illustrated in FIG. 9 or FIG. 10, the protruding portions 81 are formed into a board shape elongated in the right-and-left direction. The plurality of contact plates 72*a* and 71*a* are arrayed in the right-and-left direction along the protruding portions 81.

As described above, each ground terminal 20 and each signal terminal 30 has the first extending portions 21 and 31 extending toward the tip ends thereof, respectively. The first extending portions 21 and 31 include, at the tip ends thereof, contact portions 21*a* and 31*a* which are brought into contact with conductors formed on the lower surface of the performance board 103. The first extending portions 21 and 31 are curved so that the contact portions 21*a* and 31 are elastically movable in the up-and-down direction.

To be specific, as illustrated in FIG. 5 or FIG. 6, the first extending portions 21 and 31 include inclined portions 21*b* and 31*b*. The inclined portions 21*b* and 31*b* extend obliquely with respect to a direction perpendicular to the lower surface of the performance board 103 from the fixation portions 22*a* and 32*a* of the second extending portions 22 and 32. In this example, the inclined portions 21*b* and 31*b* facing each other extend from the fixation portions 22*a* and 32*a* such that a distance between them reduces. Further, the first extending portions 21 and 31 include curved portions 21*c* and 31*c* which extend upward from the inclined portions 21*b* and 31*b*. The curved portions 21*c* and 31*c* are curved such that inclinations thereof with respect to the lower surface of the performance board 103 gradually reduce toward their tip end (that is, the contact portions 21*a* and 31*a*). In this example, the curved portions 21*c* and 31*c* which face each other are curved such that a distance between them increases toward the top. Further, the contact portions 21*a* and 31*a* are formed so as to face to the lower surface of the performance board 103 in the up-and-down direction. Thus, when the first extending portions 21 and 31 are pressed on the lower surface of the performance board 103, the inclined portions 21*b* and 31*b* and the curved portions 21*c* and 31*c* warp such that relative positions of the contact portions 21*a* and 31*a* to the fixation portions 22*a* and 32*a* descend. Then, the contact portions 21*a* and 31*a* are pressed against the conductor formed on the lower surface of the performance board 103 by elastic forces (forces to push up the contact portions 21*a* and 31*a*) of the first extending portions 21 and 31.

As illustrated in FIG. 5 or FIG. 6, the first extending portions 21 and 31 are inserted into the first housing 19. To be specific, the first housing 19 is formed into a thick board shape, and a plurality of accommodating holes 19*a* which pass through the first housing 19 in the up-and-down direction are formed in the first housing 19. The plurality of insertion holes 19*a* are arrayed in the right-and-left direction and the front-and-back direction. The first extending portions 21 and 31 are inserted into the respective accommodating holes 19*a*.

As illustrated in FIG. 8, the plurality of accommodating holes 19*a* are holes that are independent of one another, so that the first housing 19 includes: wall portions 19*b*, each of which partitions two accommodating holes 19*a* arranged next to each other in the right-and-left direction; and wall portions 19*c*, each of which partitions two accommodating holes 19*a* arranged next to each other in the front-and-back direction. Each of the wall portions 19*c* is located between the first extending portions 21 and 31 which face each other in the front-and-back direction (refer to FIG. 5). Each of the wall portions 19*b* is located between the first extending portions 21 and 31 arranged next to each other in the right-and-left direction. The thickness of the wall portion 19*b* is defined to be larger than the thickness of wall portion 13 formed in the second housing 12.

In this context, as illustrated in FIG. 5, in a free state of the first extending portions 21 and 31, the contact portions 21*a* and 31*a* of the first extending portions 21 and 31 are located higher than an upper surface of the first housing 19. In other words, the contact portions 21*a* and 31*a* are arranged protruding upward from the accommodating holes 19*a*. Thus, when the connector 1 is pressed on the lower surface of the performance board 103, the first extending portions 21 and 31 are elastically deformed such that the positions of the contact portions 21*a* and 31*a* descend until the upper surface of the first housing 19 contacts on the lower surface of the performance board 103.

As illustrated in FIG. 7, the first extending portions 21 and 31 are formed such that their width become smaller than that of the second extending portions 22 and 32. To be specific, the first extending portions 21 and 31 are formed to be gradually thinned toward their tip ends. In this example, the inclined portions 21*b* and 31*b* are formed such that their width become substantially equal to a width W of the second extending portions 22 and 32, and meanwhile, a width of the curved portions 21*c* and 31*c* is gradually reduced toward the contact portions 21*a* and 31*a* located on the tip ends of the curved portions 21*c* and 31*c*. Therefore, a distance L between two curved portions 21*c* and 31*c* arranged next to each other in the right-and-left direction gradually increases toward the top. The width of the first extending portions 21 and 31 is defined to be gradually reduced toward their tip ends as described above, whereby elastic forces of the first extending portions 21 and 31 can be weakened, and force (reaction force received from the performance board 103) required for pressing the connector 1 against the lower surface of the performance board 103 can be reduced.

Each of the wall portions 19*b* located between the first extending portions 21 and 31 arranged next to each other in the right-and-left direction is formed so as to suppress an impedance change which results from the structure where the width of the first extending portions 21 and 31 is reduced toward their tip ends. In this example, as illustrated in FIG. 5 or FIG. 8, the thickness T of the wall portion 19*b* is gradually increased toward a position between the tip end of the first extending portion 21 and the tip end of the first extending portion 31. In other words, the wall portion 19*b* includes, on its side surfaces, inclined surfaces 19*d* inclined to be along edges of the curved portions 21*c* and 31*c*. The inclined surfaces 19*d* which face each other are inclined such that an interval between them is gradually reduced while approaching the contact portion 21*a* or 31*a* located between the inclined surfaces 19*d*.

In this example, the first housing 19 and the second housing 12 are formed of resins different in dielectric constant from each other. Specifically, a dielectric constant of a material forming the first housing 19 is defined to be larger than a dielectric constant of a material forming the second housing 12. The structure described immediately above can reduce the change of the impedance which results from the fact that the distance L between the curved portions 21*c* and 31*c* arranged next to each other in the right-and-left direction is larger than the distance between the second extending portions 22 and 32 arranged next to each other in the right-and-left direction.

The first extending portions 21 and 31 are formed so as to be freely insertable into and removable from the first housing 19. Specifically, the width of the accommodating holes 19*a* is larger than the width of the first extending portions 21 and 31, and the side surfaces of the accommodating holes 19*a* are slightly spaced apart from edges of the first extending portions 21 and 31.

The first housing 19 and the second housing 12 has convexes and recessions formed therein, which define their relative positions. In this example, as illustrated in FIG. 3, convex portions 12*b* protruding upward are formed on an upper surface of the second housing 12, and recessed portions 19*e* into which the convex portions 12*b* fit are formed on a lower surface of the first housing 19.

In a manufacturing process of the connector 1, the ground terminals 20 and the signal terminals 30 are individually press-fitted into the insertion holes 12*a* of the second housing 12 from the above, and are held in the second housing 12. The second extending portions 22 of the ground terminals 20 and the second extending portions 32 of the signal terminals 30 are accommodated in the insertion holes 12*a*. Thereafter, the second housing 12 is covered with the first housing 19 such that the respective first extending portions 21 and 31 are received in the accommodating holes 19*a*.

As illustrated in FIG. 3, fixing portions 14 are provided on an outer surface of the second housing 12. Each of the fixing portions 14 is fixed on the performance board 103, for example, by a rivet or a bolt. Specifically, the fixing portion 14 has a through-hole formed therein, which passes through the fixing portion 14. The rivet or the like is inserted through the through-hole of the fixing portion 14 and is then fixed to the performance board 103 with the first housing 19 sandwiched between the second housing 12 and the performance board 103. As described above, the contact portions 21*a* and 31*a* of the first extending portions 21 and 31 are located higher than the upper surface of the first housing 19. Therefore, when the rivets or the like are fixed to the performance board 103, the contact portions 21*a* and 31*a* of the first extending portions 21 and 31 are pressed against the lower surface of the performance board 103. In this context, the first housing 19 also includes fixing portion 19*f* on the outer surface of the first housing 19. Each of the fixing portions 19*f* has a through-hole formed therein, and the rivet or the like for fixing the housing 11 on the performance board 103 is inserted through the through-hole. Further, the first housing 19 may include a structure for fixing the first housing 19 to the second housing 12 in place of, or together with, the fixing portions 19*f* through which the rivets or the like are inserted.

As described above, the connector 1 includes a signal terminal 30 and a ground terminal 20, which are arranged next to each other. Further, the connector 1 includes the housing 11 into which the signal terminal 30 and the ground terminal 20 are inserted. The signal terminal 30 and the ground terminal 20 are formed to extend in their insertion direction into the housing 11, and include the first extending portions 21 and 31 extending toward the tip ends thereof, and the second extending portions 22 and 32 extending in a direction opposite to the first extending portions 21 and 31. The first extending portions 21 and 31 are formed to have a width smaller than that of the second extending portions 22 and 32. The housing 11 includes the first housing 19 into which the first extending portions 21 and 31 are inserted, and the second housing 12 into which the second extending portions 22 and 32 are inserted. The first housing 19 and the second housing 12 are formed separately from each other, and the first housing 19 includes the wall portion 19*b* located between the first extending portion 31 of the signal terminal 30 and the first extending portion 21 of the ground terminal 20.

According to the connector 1 as described above, it becomes easy to suppress the deterioration in impedance matching which results from the structure where the width of the first extending portions 21 and 31 is smaller than the width of the second extending portions 22 and 32. Specifically, the first housing 19 and the second housing 12 are formed separately from each other, and accordingly, compared to a structure where these are integrally molded, designing the wall portions 19*b* formed in the first housing 19 can be flexible, which can lead to suppressing the deterioration of the impedance matching.

Note that the present invention is not limited to the connector 1 described above, and a variety of alterations are possible. For example, the connector 1 is a connector of a type in which the ground terminals 20 and the signal terminals 30 are electrically connected to a conductor formed on a surface of a circuit board (performance board 103 in this example) by pressing the connector on the surface of the circuit board. However, the present invention may be applied to a connector of a so-called card edge type, which includes a housing into which the circuit board is inserted.

Further, in the above, the first extending portions 21 and 31 pressed on the performance board 103 are formed to be thinned toward their tip ends. However, the second extending portions 22 and 32 which are brought into contact with the cable terminals 70 of the cable assembly 6 may be formed to be thinned toward the tip ends. In this case, such thinned portions of the second extending portions 22 and 32 may be accommodated in a housing formed separately from the second housing 12.

Further, in the above, the ground terminals 20 and the signal terminals 30 are not only arrayed in the right-and-left direction but are also arranged to face each other in the front-and-back direction as illustrated in FIG. 4 and FIG. 5. However, the present invention may be applied to a connector including the ground terminals 20 and the signal terminals 30, which are arrayed only in the right-and-left direction.

Further, in the above, both of the first extending portions 21 of the ground terminals 20 and the first extending portions 31 of the signal terminals 30 are formed to be thinned while approaching their tip ends. However, only either of the first extending portions 21 of the ground terminals 20 and the first extending portions 31 of the signal terminals 30 may be formed to be thinned while approaching the tip ends.

Further, in the above, the first housing 19 and the second housing 12 are formed of materials that are different in dielectric constant from each other. However, the first housing 19 and the second housing 12 may be formed of materials equal in dielectric constant to each other.

We claim:

1. A connector, the connector comprising:

a signal terminal and a ground terminal, the terminals being arranged next to each other, each of the terminals including a first extending portion, extending toward a tip end thereof, and a second extending portion, extending in a direction opposite to the first extending portion, the first extending portions including a curved portion, the second extending portions including a contact portion, the curved portion of at least one of the signal terminal and the ground terminal has a width smaller than a width of the contact portion of at least one of the signal terminal and the ground terminal; and an insulative housing, into which the signal terminal and the ground terminal are inserted, the housing including a first housing, into which the first extending portions of the terminals are inserted, and a second housing, into which the second extending portions of the terminals are inserted, the second housing being formed separately from the first housing, the first housing including a wall portion, the wall portion being located between the first extending portion of the signal terminal and the first extending portion of the ground terminal.

2. The connector of claim 1, wherein the first extending portion having the smaller width is formed such that the width thereof becomes smaller toward the tip end thereof.

3. The connector of claim 2, wherein the first extending portions further include, on their tip side, a contact portion for contacting a surface of an electronic component, where the connector is mounted on the surface, and the first extending portions are curved so that a position of the contact portion is elastically movable up and down.

4. The connector of claim 2, wherein the wall portion becomes thicker toward the portion between the tip end of the first extending portion of the signal terminal and the tip end of the first extending portion of the ground terminal.

5. The connector of claim 1, wherein the housings are formed of materials different in dielectric constant from each other.

6. The connector of claim 1, wherein the terminals are held in the second housing in such a manner that the second extending portions thereof are press-fit into the second housing.

7. A semiconductor testing device comprising the connector of claim 1, the semiconductor testing device comprising a circuit board on which the connector is mounted.

* * * * *